US006367662B1

(12) United States Patent
Dorman et al.

(10) Patent No.: US 6,367,662 B1
(45) Date of Patent: Apr. 9, 2002

(54) LIQUID DISPENSER

(75) Inventors: H. Paul Dorman, Fort Worth, TX (US); John W. Feik, Jr., Scottsdale, AZ (US); Shawn Gentry, Kellar, TX (US)

(73) Assignee: Healthpoint, Ltd., Fort Worth, TX (US)

( * ) Notice: Subject to any disclaimer, the term of this patent is extended or adjusted under 35 U.S.C. 154(b) by 0 days.

(21) Appl. No.: 09/541,809

(22) Filed: Apr. 3, 2000

(51) Int. Cl.[7] ..... B67D 5/06

(52) U.S. Cl. ..... 222/181.3; 222/490; 222/209; 222/179

(58) Field of Search ..... 222/490, 494, 222/209, 179, 181.2, 181.3

(56) References Cited

U.S. PATENT DOCUMENTS

| | | | | |
|---|---|---|---|---|
| 1,919,257 A | | 7/1933 | Renzenhausen | |
| 2,153,156 A | | 4/1939 | Pollnow | |
| 2,628,744 A | * | 2/1953 | Mowbray | 222/179 |
| 2,652,952 A | * | 9/1953 | Mowbray | 222/179 |
| 2,665,825 A | * | 1/1954 | Poitras et al. | 222/179 |
| 3,233,787 A | * | 2/1966 | Ross | 222/179 |
| 4,618,065 A | | 10/1986 | Guth | |
| 4,651,902 A | | 3/1987 | Hobbs et al. | |
| 5,222,633 A | | 6/1993 | Blake | |
| 5,269,444 A | * | 12/1993 | Wright | 222/190 |
| 5,312,018 A | | 5/1994 | Evezich | |
| 5,351,710 A | | 10/1994 | Phillips | |
| 5,439,143 A | * | 8/1995 | Brown et al. | 222/185 |
| 5,947,338 A | * | 9/1999 | Budsworth et al. | 222/181.3 |
| 5,996,851 A | * | 12/1999 | Dolan et al. | 222/179 |
| 6,053,369 A | * | 4/2000 | Hoang et al. | 222/190 |

FOREIGN PATENT DOCUMENTS

| | | |
|---|---|---|
| EP | 0 905 038 A1 | 3/1999 |

* cited by examiner

*Primary Examiner*—Henry C. Tuen
*Assistant Examiner*—Stephanie L Willatt
(74) *Attorney, Agent, or Firm*—McKee, Voorhees & Sease P.L.C.

(57) ABSTRACT

A liquid dispenser is provided for dispensing a desired amount of liquid from a bottle, without leakage or dripping. The bottle is mounted in a fixture attached to a wall. The bottle includes an inlet and an outlet, with one-way valves operatively sealed in the inlet and outlet ports. A foot pump is operatively connected to the inlet valve for the inlet port, such that air may be pumped into the bottle to pressurize the contents thereof. Upon pressurization, the liquid is forced through the outlet valve in the outlet port. An air filter is provided for the pump, so as to preclude contamination of liquid in the bottle.

14 Claims, 4 Drawing Sheets

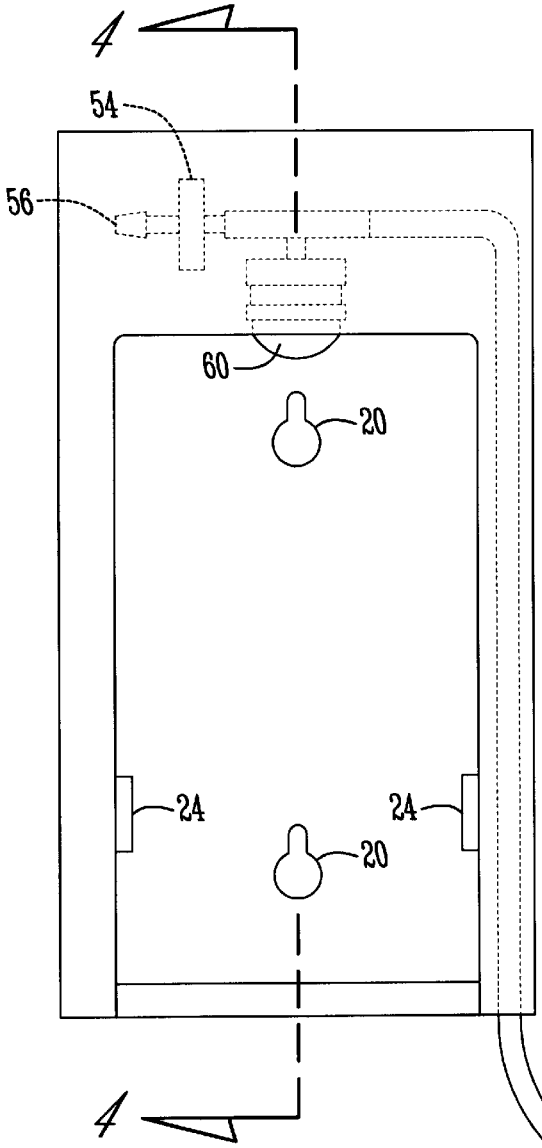
Fig. 4
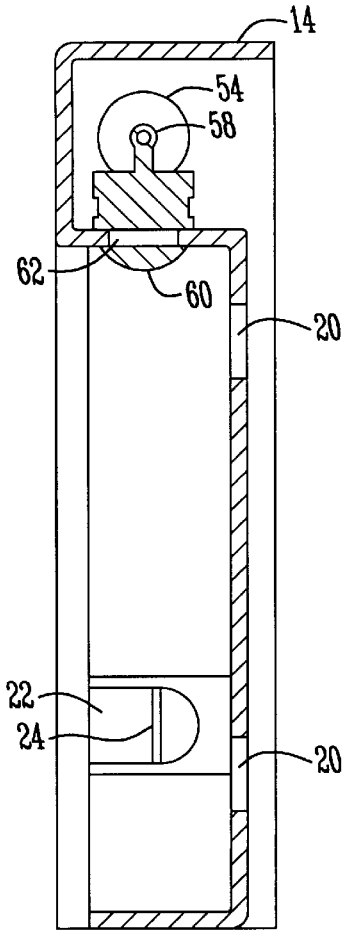
Fig. 3
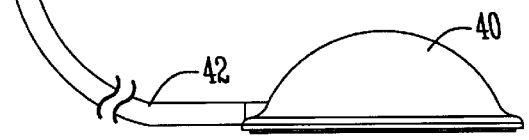

LIQUID DISPENSER

BACKGROUND OF THE INVENTION

Liquid dispensers for various liquid products are well known and generally comprise a bottle containing the liquid, with a discharge port through which the liquid is dispensed. Various mechanisms are used for dispensing the liquid from the bottle. However, a common problem with prior art dispensers is leakage or dripping of the liquid from the bottle after a desired liquid volume has been discharged or dispensed. Another problem with prior art dispensers is the inability to dispense 100% of the liquid from the bottle. Rather, dispensers typically retain 5–10% of the liquid in the bottle after the bottle is "emptied."

Accordingly a primary objective of the present invention is the provision of an improved liquid dispenser.

Another objective of the present invention is the provision of a liquid dispenser that does not leak or drip liquid after a desired volume has been dispensed.

A further objective of the present invention is the provision of a liquid dispenser that dispenses 100% of the liquid in the bottle.

Anther objective of the present invention is the provision of a liquid dispenser having a blow-molded bottle with an inlet port and an outlet port.

A further objective of the present invention is the provision of a liquid dispenser wherein the bottle containing the liquid can be quickly and easily mounted in a wall fixture for use.

Another objective of the present invention is a provision of a liquid dispenser having a foot pump for selectively pressurizing the liquid container with air.

A further objective of the present invention is the provision of a liquid dispenser that allows for accurate dispensing of a desired volume of liquid.

Another objective of the present invention is a liquid dispenser that is economical to manufacture, and durable and safe in use.

These and other objectives will become apparent from the following description of the invention.

SUMMARY OF THE INVENTION

The liquid dispenser of the present invention includes a fixture, which is adapted to mount on the wall. A liquid containing bottle is adapted to snap fit into the fixture. The bottle includes an inlet port and an outlet port. Each port is sealed with a one-way valve, with the inlet valve allowing air to be introduced into the bottle, and the outlet valve allowing liquid to be dispensed from the bottle when the bottle is pressurized with air. A foot pump is provided for supplying air into the bottle through the inlet valve. An air filter is provided on the air conduit so that air is purified before introduction into the bottle.

DETAILED DESCRIPTION OF THE PREFERRED EMBODIMENT

Figure 1:
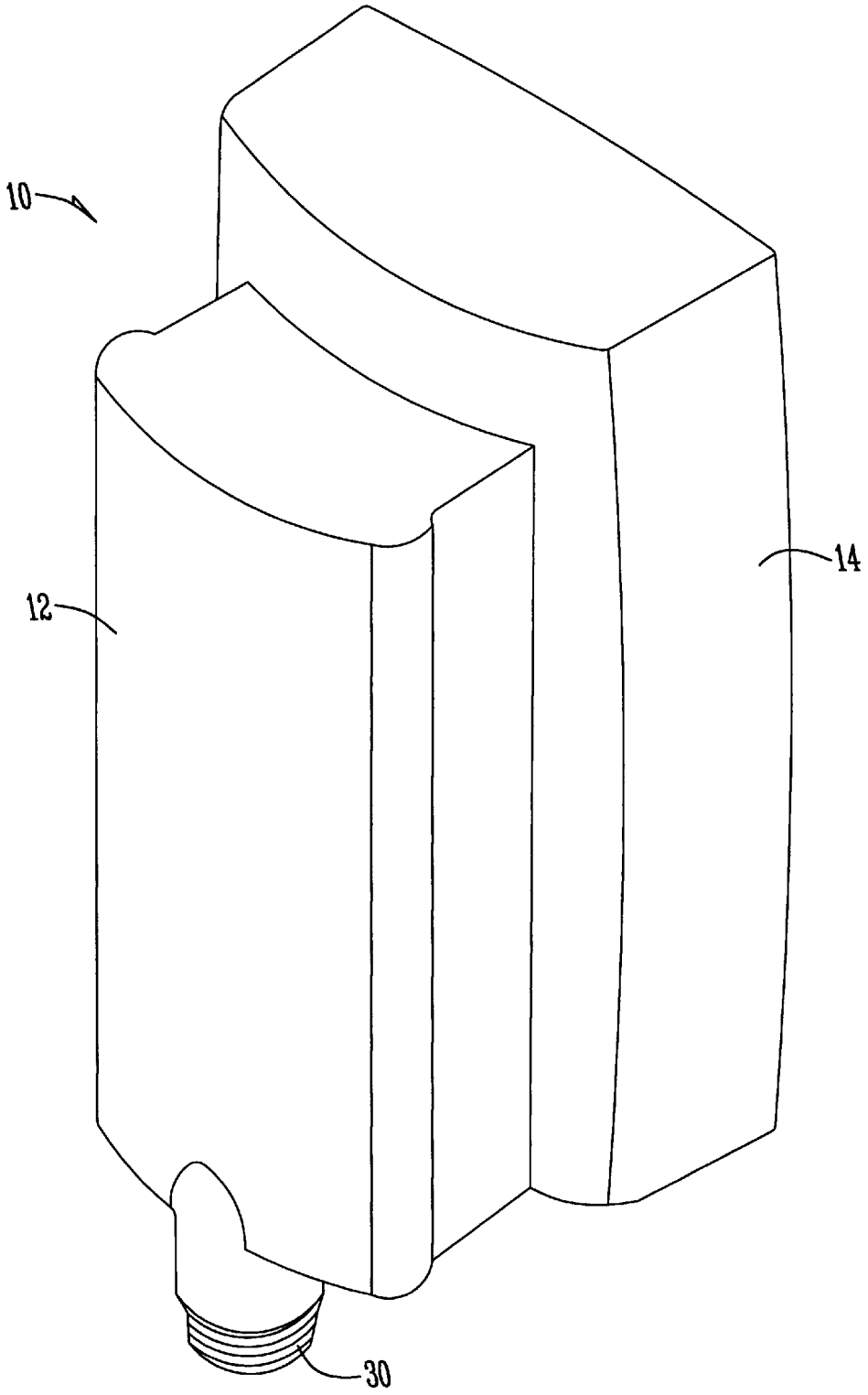
FIG. 1 is a perspective view of the liquid dispenser fixture and bottle of the present invention.
Figure 2:
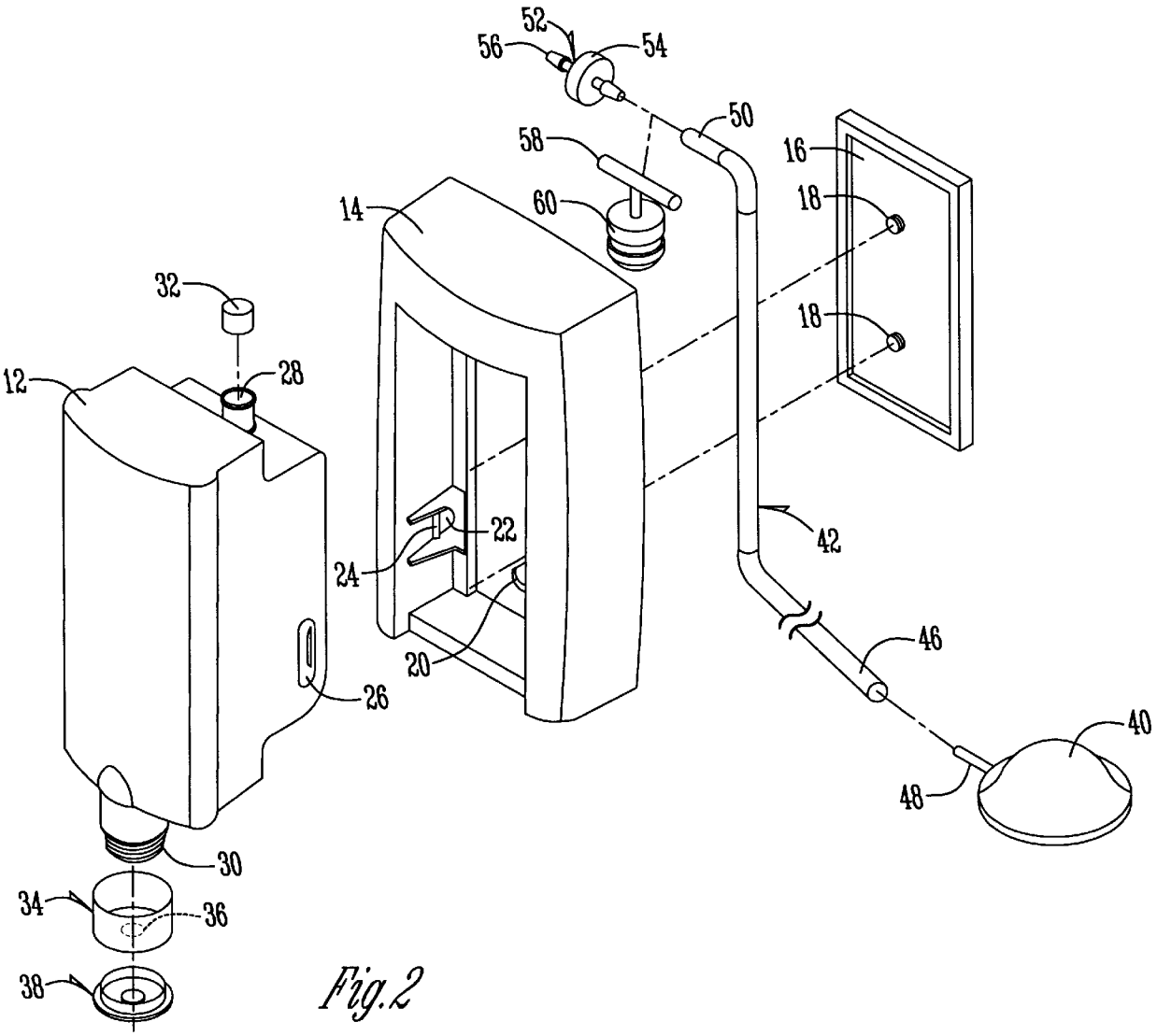
FIG. 2 is an exploded view of the liquid dispenser of the present invention.

The dispenser of the present invention is generally designated by the reference numeral 10 in the drawings. The dispenser 10 generally includes a bottle 12 for containing liquid to be dispensed, and a fixture 14 in which the bottle 12 is mounted. As seen in FIG. 2, the fixture 14 is adapted to be mounted to a wall plate 16 so that the dispenser 10 can be mounted on a wall. The wall plate 16 includes projections or keys 18 which are adapted to be received within keyed slots 20 in the back wall of the fixture 14 so that the fixture can be quickly and easily mounted on the wall.

As best seen in FIG. 2, the fixture 14 includes opposite sides with a spring clip 22 in each side. Each spring clip 22 includes a ridge 24 which is adapted to engage a recess 26 on opposite sides of the bottle 12, thereby retaining the bottle 12 in the fixture 14.

The bottle 12 includes an inlet port 28 and an outlet port 30. A threaded inlet cap 32 is provided for closing the inlet port 28 when the bottle 12 is not mounted in the fixture 14. A threaded outlet cap 34 is provided on the outlet port 30. The cap 34 has an opening therein which is normally closed by a self-sealing, non-drip valve 36. The valve 36 preferably includes a silicone membrane with cross-hair slits transecting the membrane. Such a valve is commercially available and known as a Zell Valve. A removable lid 38 is provided for the outlet cap 34 to enclose the valve 36 for storage and transport of the bottle 12.

A foot pump 40 is connected via a tube or conduit 42 to the inlet port 28 of the bottle 12. More particularly, the foot pump 40 is a bulb-type pump with a flat bottom surface 44 adapted to sit upon the floor. One end 46 of the tube 42 is connected to a coupler 48 on the foot pump 40. The tube 42 extends into the fixture 14 through a slot therein (not shown). The opposite end 50 of the tube 42 is operatively connected to a one-way air valve 52 having an air filter 54 disposed therein. The valve 52 includes an air inlet end 56.

A T-branch 58 is provided in the tube 42 downstream from the air filter 54. The T-branch 58 terminates in a one-way air valve 60 mounted in an aperture 62 in the fixture 14. The air valve 60 provides an air tight seal with the inlet port 28 of the bottle 12 when the bottle is mounted in the fixture 14.

In use, the fixture 14 is mounted on the wall plate 16 on a wall at a convenient location. The liquid-containing bottle 12 is snap fit into the fixture 14 such that the ridges 24 on the spring clips 22 retentively engage the recesses 26 in the sidewalls of the bottle 12. Before mounting the bottle 12 in the fixture, the cap for the inlet port 28 is removed. When the bottle 12 is mounted in the fixture 14, the air valve 60 creates an air tight seal with the inlet port 28. The lid 38 is removed from the cap 34.

When it is desired to discharge liquid from the bottle 12, the foot pump 40 is depressed with a user's foot, thereby forcing air through the tube 42 and the air valve 60 so as to introduce the air into the bottle 12. Thus, actuation of the foot pump 40 pressurizes the contents of the bottle 12. The pressure in the bottle 12 moves the flaps or membrane of the Zell valve 36 to an open position, thereby dispensing liquid from the container. The air from the foot pump 40 has previously been filtered by the air filter 54, such that air entering the bottle 12 is purified. Accordingly, contamination of the liquid in the bottle 12 is precluded, which is important for certain liquids, such as antiseptics.

When the user's foot is removed from the foot pump 40, air is drawn in through the inlet end 56 of the tube 42 and through the air filter 54 so as to re-pressurize the bulb of the foot pump 40. Thus, the foot pump 40 can be repeatedly depressed to obtain the desired amount of liquid from the bottle 12.

While this dispenser is particularly designed for use in the medical industry, with the bottle 12 containing liquids for surgical pre-scrubs, antiseptics, and the like, it is understood that the bottle 12 may contain other liquids, such as soap, hand lotion, shampoo, food condiments such as ketchup, and other liquids with a relatively high viscosity. By pumping the pump 40 to pressurize the bottle 12, substantially 100% of the liquid can be dispensed from the bottle.

The preferred embodiment of the present invention has been set forth in the drawings, specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A liquid dispenser, comprising:

a bottle for holding liquid to be dispensed, and having an air inlet port and a liquid outlet port;

a one-way air inlet valve sealed to the air inlet port;

a one-way outlet valve on the outlet port through which liquid is dispensed from the bottle;

an air pump operatively connected to the inlet port to pressurize the bottle to dispense liquid therefrom when the pump is activated; and a fixture for supporting the bottle, the fixture being adapted to mount to a wall, wherein the one-way air inlet valve is on the fixture, and is operatively connected to the pump, whereby the inlet port of the bottle seals within the inlet valve when the bottle is mounted in the fixture.

2. The liquid dispenser of claim 1 wherein the pump is a foot pump with an air tube extending between the foot pump and the inlet port.

3. The liquid dispenser of claim 1 further comprising an air tube providing communication from the air pump to the inlet port, and an air filter in the air tube.

4. The liquid dispenser of claim 1 further comprising a one-way valve operatively connected to the pump to provide air to the pump.

5. The liquid dispenser of claim 1 wherein the bottle snap fits into the fixture.

6. The liquid dispenser of claim 1 wherein the one-way outlet valve includes a flexible membrane with cross-hair slits moveable between open and closed positions, the slits normally being closed to prevent dripping of liquid from the bottle, and being opened upon pressurization of the bottle by the air pump.

7. The liquid dispenser of claim 1 wherein the bottle is blow molded.

8. The liquid dispenser of claim 1 wherein the pump is a bulb pump.

9. A method of dispensing liquid from a bottle, the bottle being supported by a fixture adapted to mount to a wall wherein a one-way air inlet valve is on the fixture, the bottle having an inlet port operatively associated with the one-way inlet valve, whereby the inlet port of the bottle seals within the inlet valve when the bottle is mounted in the fixture, the bottle further including an outlet port with a one-way outlet valve operatively associated therewith, the method comprising:

introducing air through the inlet valve of the fixture and into the bottle so as to pressurize air within the bottle and thereby forcing liquid through the outlet valve.

10. The method of claim 9 wherein the air is introduced by depressing a foot pump.

11. The method of claim 10 further comprising supplying air to the foot pump through a one-way valve.

12. The method of claim 9 further comprising filtering the air before introduction into the bottle.

13. The liquid dispenser of claim 1 wherein the bottle has an upper and a lower end, the inlet port being on the upper end and the output port being on the lower end.

14. The method of claim 9 wherein the air is introduced into the inlet port at an upper end of the bottom, and the liquid is dispensed from the outlet port at a lower end of the bottle.

* * * * *

UNITED STATES PATENT AND TRADEMARK OFFICE

CERTIFICATE OF CORRECTION

Figure 3:
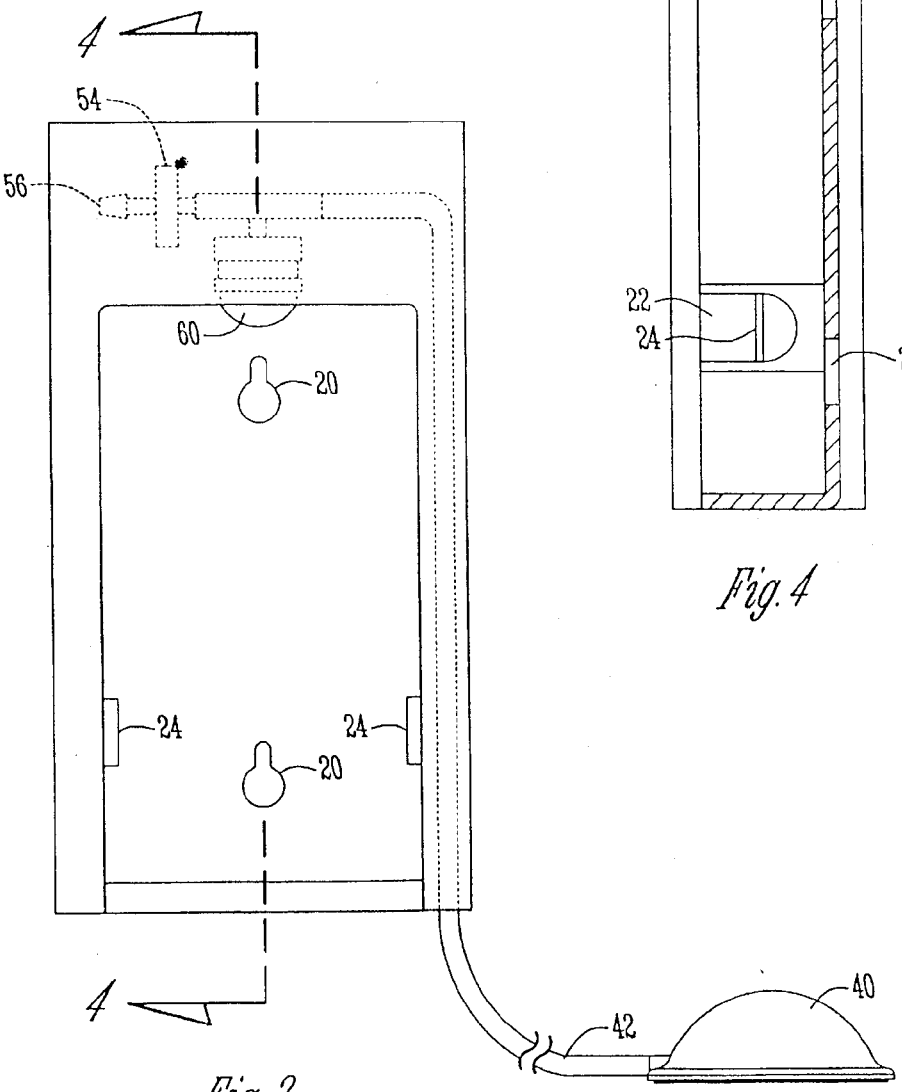
FIG. 3 is a front elevation view of the fixture for holding the bottom of the present invention.
Figure 4:
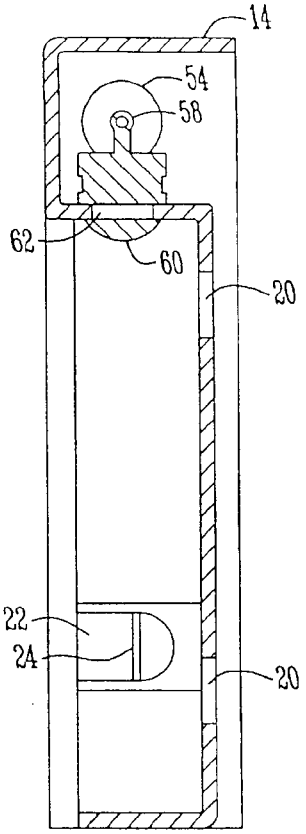
FIG. 4 is a side elevation view of the foot pump of the present invention.

PATENT NO. : 6,367,662 B1 
DATED : April 9, 2002
INVENTOR(S) : H. Paul Dorman, John W. Feik, Jr. and Shawn Gentry It is certified that error appears in the above-identified patent and that said Letters Patent is hereby corrected as shown below:

Drawings,
Sheet 3 of 4, the labels for Fig. 3 and Fig. 4 should be reversed so that the figures correspond to the drawing description, as corrected, and as shown in the attached page.

Column 1,
Line 65, change "bottom" to -- bottle --.
Lines 66-67, change "Fig. 4 is a side elevation view of the foot pump of the present invention" to -- Fig. 4 is a sectional view taken along lines 4-4 of Fig. 3 --.

Figure 5:
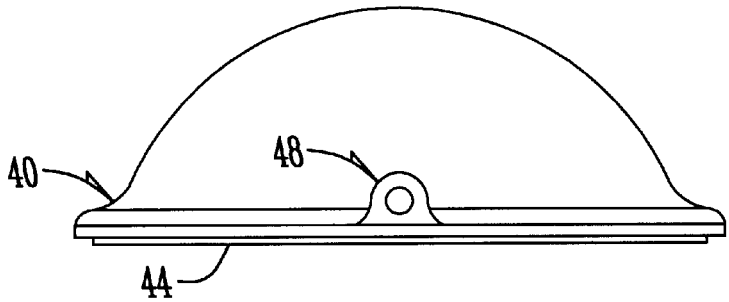
FIG. 5 is a sectional view taken along lines 4—4 of FIG. 3.
Figure 6:
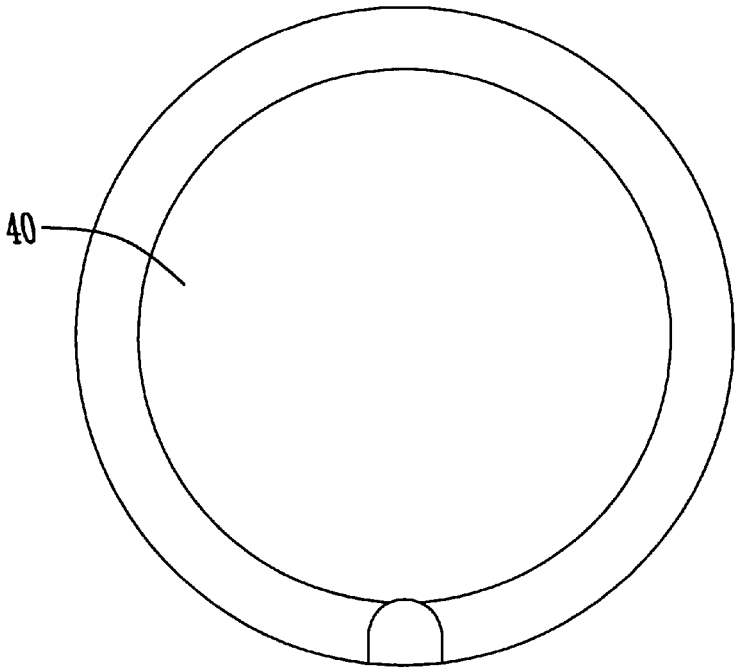
FIG. 6 is a top plan view of the foot pump of the present invention.

Column 2,
Lines 1-2, change "Fig. 5 is a sectional view taken along lines 4-4 of Fig. 3" to -- Fig. 5 is a side elevation view of the foot pump of the present invention. --

Signed and Sealed this

Twenty-second Day of July, 2003

JAMES E. ROGAN
*Director of the United States Patent and Trademark Office*